United States Patent [19]

Gottwald et al.

[11] Patent Number: 4,662,768

[45] Date of Patent: May 5, 1987

[54] CLEANING AND WASHING APPLIANCE

[75] Inventors: Adolf Gottwald, Iserlohn; Odo Klose, Wuppertal; Wilfried Koster, Menden, all of Fed. Rep. of Germany

[73] Assignee: Friedrich Grohe Armaturenfabrik GmbH & Co., Hemer, Fed. Rep. of Germany

[21] Appl. No.: 585,359

[22] Filed: Mar. 1, 1984

[30] Foreign Application Priority Data

Feb. 28, 1983 [DE] Fed. Rep. of Germany ..... 3306946

[51] Int. Cl.[4] ..... B05C 17/00; A46B 11/06

[52] U.S. Cl. ..... 401/139; 239/25; 239/289; 239/587; 401/42; 401/203; 401/289

[58] Field of Search ..... 401/42, 43, 139, 289, 401/203, 204, 290; 239/25, 26, 27, 289, 391, 587; 285/8; 4/605, 568, 606, 567, 570

[56] References Cited

U.S. PATENT DOCUMENTS

| | | | |
|---|---|---|---|
| 1,044,278 | 11/1912 | Smith et al. | 401/289 |
| 1,132,449 | 3/1915 | Cox | 401/139 |
| 1,151,832 | 8/1915 | Serrell | 401/42 |
| 1,278,225 | 9/1918 | Schamberg | 401/42 |
| 1,362,533 | 12/1920 | Higley | 401/139 |
| 1,496,635 | 4/1921 | Higley . | |
| 1,598,742 | 9/1926 | Parker | 401/203 X |
| 1,598,811 | 9/1926 | Ferrin | 401/289 X |
| 1,642,933 | 9/1927 | McGrath | 401/42 X |
| 2,265,804 | 12/1941 | Deady | 401/203 |
| 2,501,426 | 3/1950 | Voorhees | 401/43 |
| 2,516,195 | 7/1950 | Finton | 401/289 |
| 2,652,850 | 9/1953 | Manville | 401/46 X |
| 2,789,864 | 4/1957 | Guldjord | 239/26 |
| 2,790,632 | 4/1957 | Mellette | 239/26 |
| 2,944,271 | 7/1960 | Foster . | |
| 3,197,800 | 8/1965 | Karkut | 401/290 X |
| 3,680,780 | 8/1972 | Arbon | 239/587 X |
| 3,869,216 | 3/1975 | Cseke | 401/43 |

FOREIGN PATENT DOCUMENTS

| | | | |
|---|---|---|---|
| 927621 | 5/1955 | Fed. Rep. of Germany | 401/289 |
| 2827847 | 1/1980 | Fed. Rep. of Germany . | |
| 3033943 | 7/1982 | Fed. Rep. of Germany | 4/605 |
| 8206052 | 7/1982 | Fed. Rep. of Germany . | |
| 651468 | 1/1963 | Italy | 401/42 |
| 459502 | 1/1937 | United Kingdom | 4/570 |
| 565318 | 11/1944 | United Kingdom . | |

*Primary Examiner*—Steven A. Bratlie

*Attorney, Agent, or Firm*—Karl F. Ross; Herbert Dubno

[57] ABSTRACT

A hand held kitchen sink spray is disclosed with various cleaning attachments. The attachments are attached by a quick-release connector.

8 Claims, 14 Drawing Figures

CLEANING AND WASHING APPLIANCE

FIELD OF THE INVENTION

The invention concerns a hand-held applicance for washing and cleaning kitchen and household dishes etc. with a handle and a water supply.

BACKGROUND OF THE INVENTION

Hand-held kitchen sink spray heads provided for washing dishes are known. It is also known to position the hand-held spray head in the outlet of the tap fitting whereby the hand-held spray head when in an inserted position can be used as stationary outlet and by removal from the outlet can be used as a hand-held spray for dish washing. The known devices do not however suffice for thorough cleaning of kitchen utensils, etc.

OBJECT OF THE INVENTION

An object of the invention is to provide an easy to handle cleaning and washing appliance through which water flows and can be ideally suited to the requirements in question in a simple fashion.

SUMMARY OF THE INVENTION

In accordance with the invention, cleaning attachments can easily be connected to the kitchen pipe fitting by means of a quick release connector, it thereby being possible to achieve optimum cleaning effect with the water emerging from the attachment. Advantageously, the device is supplied with water from a hose so that it can act both as freely movable appliance and as outlet of the kitchen pipe fitting. The quick release connector can also, of course, be formed on a rigid pipe so that the cleaning attachments etc. are supported by the pipe.

The attachments are wearing parts which for practical purposes are attached by screw thread to a handle to permit simple renewal when worn.

For optimum ease of handling and location in the hand of the user, the hand-held appliance can advantageously be provided with a handle which enlarges to form a head at its downstream end. In the head, a thread can be provided for connection of the attachment to the handle.

For cleaning and washing purposes it has been found effective and particularly suited to fit the hand-held appliance with a range of attachments such as saucepan and pan scraper, baby bottle brush, jet tube, right angle attachment, with outlet device, water spray head and multi-jet spray hose.

The quick release connector can be fitted with a projecting connection nozzle with a slightly conical sleeve nut for connection of a hose for water supply. The conical cylindrical portion of the sleeve nut can be secured in a suitably shaped outlet pipe of the kitchen pipe fitting. By this means, it is possible to secure the hand-held applicance positively on the pipe fitting. By means of the conical holder the hand-held appliance can also in the case of a swivel mounted outlet pipe be directed as required into the sink by turning about its longitudinal axis. On the other hand, the hand-held appliance can be used as required for manual cleaning operations simply by pulling out the hand-held appliance with its hose from the outlet pipe.

BRIEF DESCRIPTION OF THE DRAWING

The invention will be better understood from a reading of the following detailed description in conjunction with the drawings in which like parts are designated with the same numbers and in which.

SPECIFIC DESCRIPTION

Figure 1:
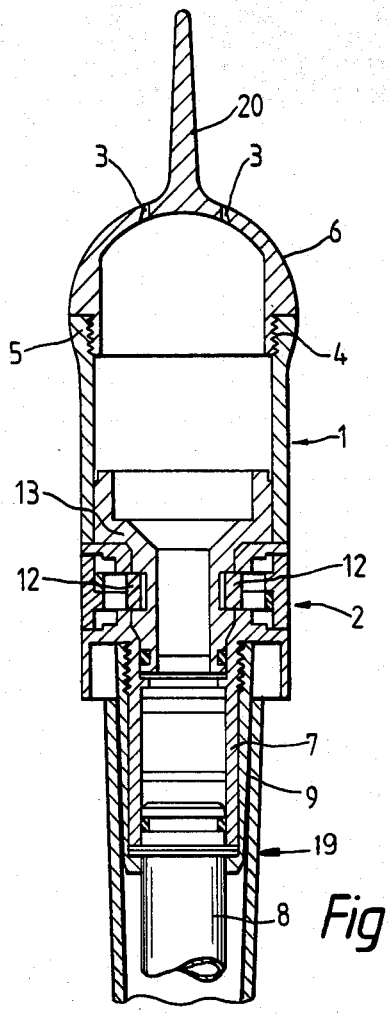
FIG. 1 is a longitudinal section through a hand-held appliance in the form of a saucepan or pan scraper.
Figure 2:
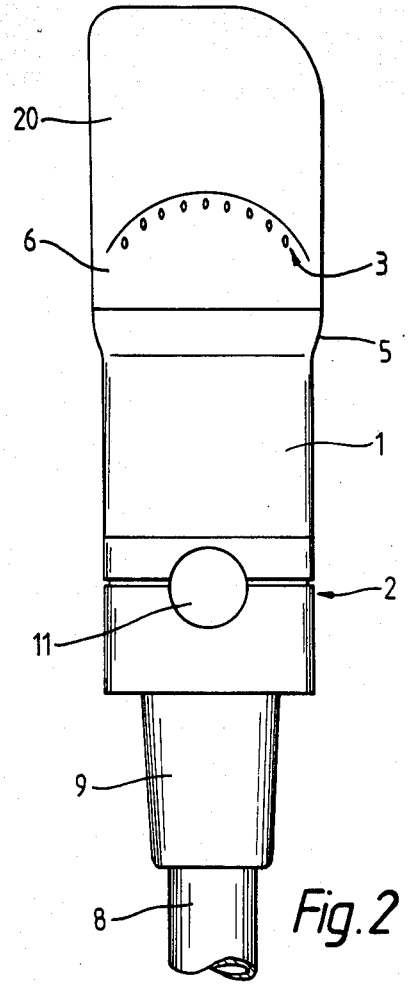
FIG. 2 shows the hand-held appliance of FIG. 1 turned through 90°.
Figure 3:
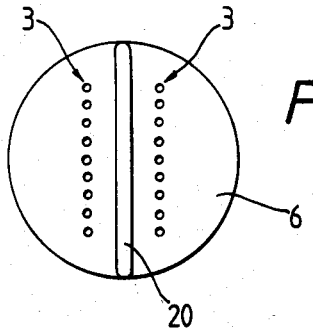
FIG. 3 is a top or end view of the hand-held appliance.

The hand-held appliance shown in FIGS. 1 to 3 is designed as saucepan and pan scraper. Water supply from the kitchen pipe fitting 19, which is a part of faucet 70, is supplied via a hose 8. Attached to the end of hose 8 is a quick release connector 2. Quick release connector 2 connects hose 8 to a hollow handle 1 on to which a saucepan and pan scraper 20 is attached with a thread 4. The quick release connector may be, for example, the quick release pipe connector described in DE-PS 28 27 847. The connector is released by radially depressing buttons 11 with which locking catches 12 can be disengaged from an annular groove of a coupling stud 13 of handle 1 so that coupling stud 13 along with handle 1 can be withdrawn from quick release connector 2. Connection of quick release connector 2 to handle 1 is effected by pushing coupling stud 13 into quick release connector 2 until the locking catches 12 snap into position. By providing an annular groove in coupling stud 13 in which locking catches 12 engage, it is possible for handle 1 with the appropriate attachment to be rotated unrestrictedly relative to hose 8.

On the upstream end face of quick release connector 2 a projecting connection nozzle 7 is formed. Hose 8 for the water supply is attached to nozzle 7 by means of a slightly conical, suitably projecting sleeve nut 9. In the case of the kitchen water fitting not shown in the drawing, hose 8 is passed through an outlet pipe which has at its end a suitably tapered holder for sleeve nut 9 so that the hand-held appliance can be securely fitted into and retained on the pipe fitting 19.

On the downstream section of handle 1, a head 5 is also formed having an inside thread 4 formed for securing the attachment. The head 5 is followed by a suitably shaped hemispherical section of the saucepan and pan scraper 20 on which is formed the scraper blade. In the hemispherical section 6 of the saucepan and pan scraper 20, parallel to the scaper blade, are also provided water outlet orifices 3 slightly inclined in relation to the center axis.

Figure 5:
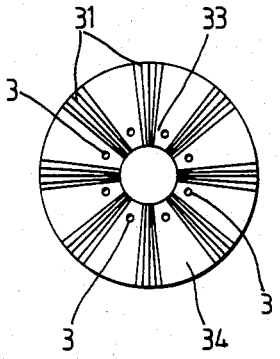
FIG. 5 is an end view of the hand-held appliance of FIG. 4.
Figure 4:
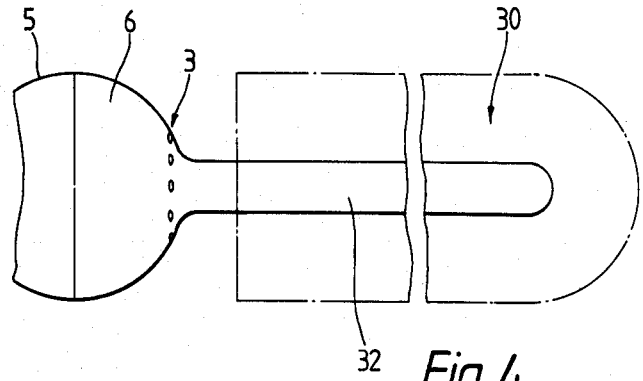
FIG. 4 is a side view of another hand-held applicance with a bottle brush.

FIGS. 4 and 5 partially show the hand-held appliance in the form of a brush 30. Brush 30 also includes a hemispherical section 6 joined to head 5 with thread 4. On hemispherical section 6 is located a cylindrical projection 32 to which the bristles 31 are attached in conventional manner. In hemispherical section 6 approximately parallel to the center axis there is a series of water outlet orifices located around a pitch circle 33 such a way that the emerging water jets are directed into gaps 34 between the bristles 31.

Figure 7:
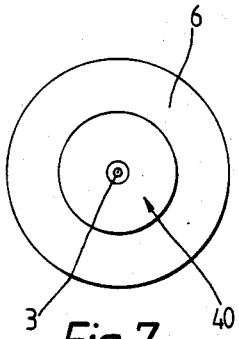
FIG. 7 is an end hand view of the hand-held appliance as per FIG. 6.
Figure 6:
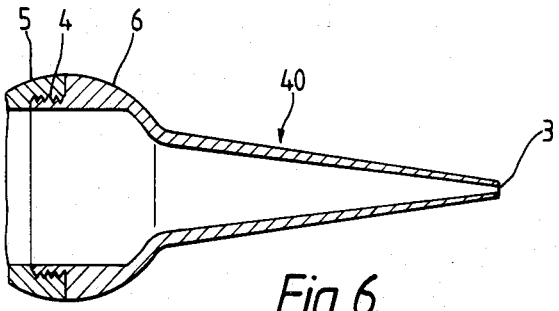
FIG. 6 is a longitudinal section through a portion of a hand-held appliance with a jet tube.

In FIGS. 6 and 7 the partially shown hand-held appliance is provided with a jet tube 40 as attachment. Jet tube 40 is designed so as to produce a powerful needle-like jet of water.

Figure 9:
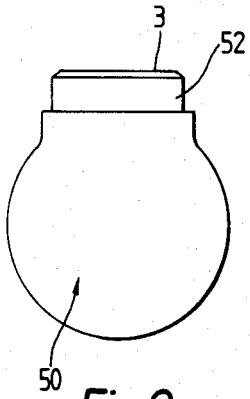
FIG. 9 is or end hand view of the hand-held appliance of FIG. 8.
Figure 8:
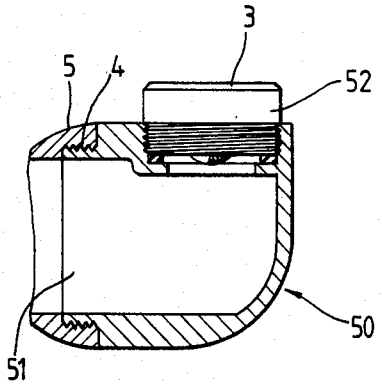
FIG. 8 is a longitudinal section through a partially drawn hand-held appliance with a right angle attachment.

In FIGS. 8 and 9 the partially shown hand-held appliance is provided with a right angle attachment 50. The water outlet orifices 3 are offset by approximately 90° to water inlet passage 51. As water outlet orifice 3 a discharge nozzle 52 is provided which produces either an aerated or unaerated water jet. The hand-held appliance with right angle attachment 50 can advantageously be used as washing spray or as discharge nozzle for the sink pipe fitting.

Figure 10:
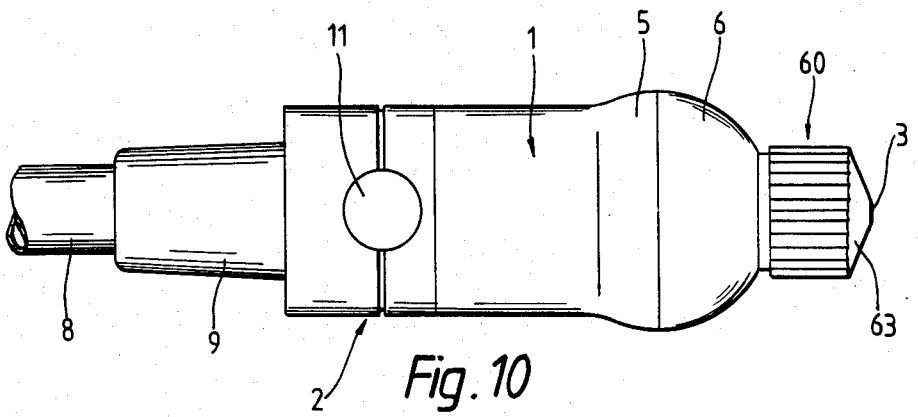
FIG. 10 is a side view of a hand-held appliance with a spray head.
Figure 11:
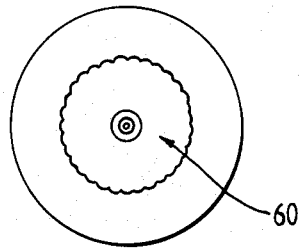
FIG. 11 is an end view of the hand-held appliance of FIG. 10.
Figure 12:
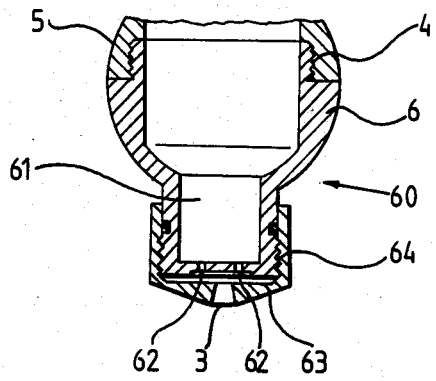
FIG. 12 is a cross-section through the right end portion of the hand-held appliance of FIG. 10.
Figure 13:
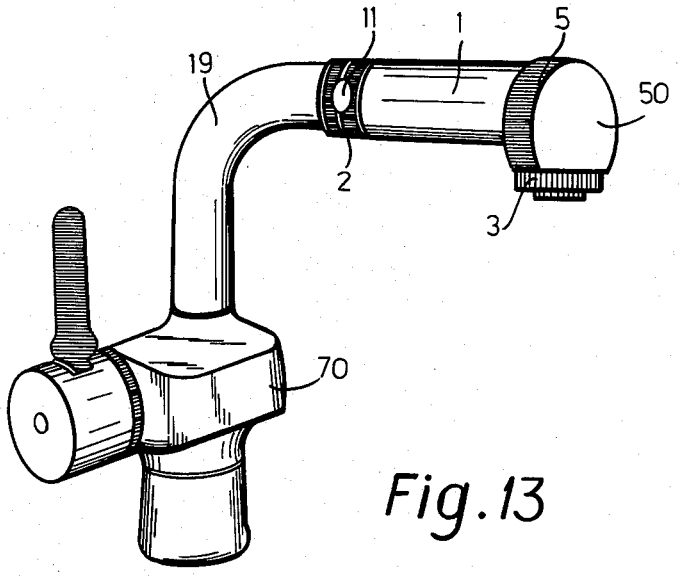
FIG. 13 is is a perspective view of the sink faucet with the hand-held appliance in the retracted position.
Figure 14:
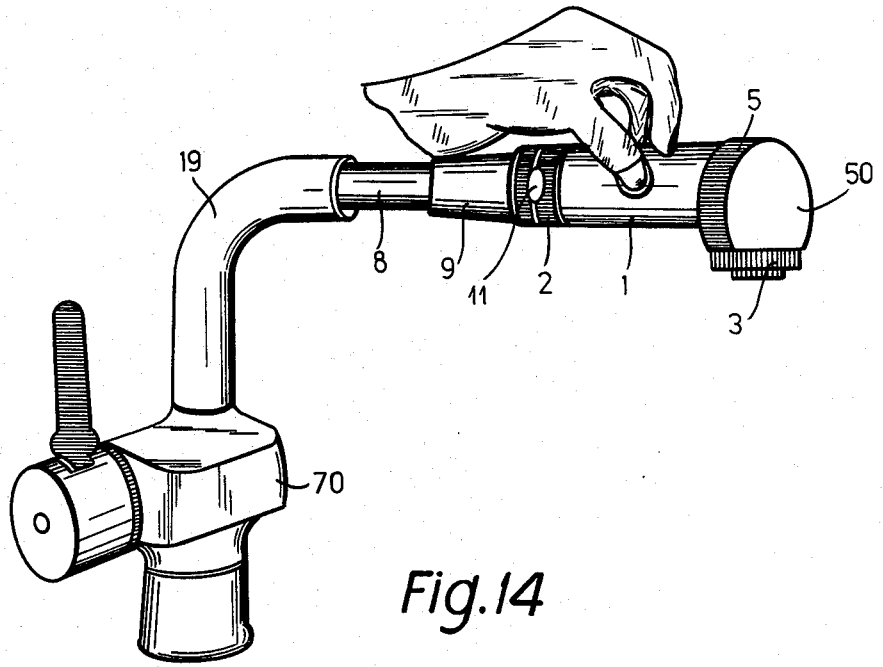
FIG. 14 is a view similar to FIG. 13 except the hand-held appliance is in the partially extended position.

In FIGS. 10 to 12 the hand-held appliance is shown with a water spray head 60. As can be seen particularly from FIG. 12, a spigot 61 is formed on the hemispherical section 6 whose end face has a number of jet nozzles offset relative to the center axis. The jet nozzles 62 are directed on to a cup-shaped deflector 63 which is secured on spigot 61 with a thread 64. In the center of deflector 63 a water outlet orifice 3 is provided through which the atomized spray produced by deflector 63 emerges.

The appliance described above has the following principle of operation:

hose 8 with quick release connector 2 is rigidly connected to a sink pipe fitting. With quick release connector 2 it is possible to attach to hose 8 a variety of hand-held appliances which are, for example, fitted with a saucepan and pan scraper 20 or a jet tube 40, a right angle attachment 50 or a water spray head 60. The individual hand-held appliances can be stored in a magazine and can be easily attached to the kitchen pipe fitting as required with the aid of the quick release connector. A saucepan and pan scraper 20 attached to the kitchen pipe fitting in this way can be supplied with water for the scraper blade section through the hollow handle 1. The water outlet orifices 3 in saucepan and pan scraper 20 are directed such that the scraper blade is sprayed with water over its entire surface.

If containers or, for example, baby bottles have to be cleaned, the saucepan and pan scraper 20 can be returned to the magazine and replaced by a hand-held appliance with a brush 30. Water is supplied to the work section of the brush because hemispherical section 6 has water outlet orifices arranged along a pitch circle 33. The outlet jets are directed so that they impinge on the gaps 34 between brushes 31.

For other purposes a hand-held appliance with a jet tube 40 may be necessary to produce a concentrated needle jet, this being effected quite simply by changing the hand-held appliances at quick release connector 2.

For use as a hand-held spray or in particular as stationary water outlet from the kitchen pipe fitting, a hand-held appliance with a right angle attachment 50 can be used. Here the water outlet orifice 3 is offset approximately 90° in relation to water inlet passage 51 and the inflowing water is passed through a discharge nozzle 52 with which it is possible to produce and aerated or unaerated water jet. By means of the hand grip 1 rotatably located in quick release connector 2, it is also possible to achieve the effect that on swivelling the outlet pipe of the sink pipe fitting it is possible to direct the water jet, for example into the center of the sink.

For spraying with water, it is also possible to attach a hand-held appliance with a spray head 60 by means of the quick release connector. The water to be sprayed is forced through net nozzles 62 and atomized on deflector 63 so that a spray emerges from water outlet orifice 3.

The attachments described above are subject to wear during use. An attachment which has become unserviceable or no longer complies with hygienic requirements can be renewed relatively simply by unscrewing from thead 4 of handle 1. It is possible to continue using handle 1.

Finally, the hand-held appliance can be provided in the area of handle 1 with a flow regulator and shut off valve.

We claim:

1. A hand-held appliance at a sink for washing and cleaning household dishes and the like with water, said appliance comprising:

a flexible water-supply hose connectable to a kitchen-sink fixture;

a quick-release connector first portion on an end of said flexible water-supply hose;

an attachment having at least one water-outlet orifice and comprising:

an elongated handle portion formed with:

a generally cylindrical shank,.

an extremely generally spherically curved convex boss at one end of said shank and merging therewith, a quick-release connector second portion adapted to mate with said quick-release connector first portion, and a coupling formation on said boss, and a working portion formed with said orifice having a coupling formation on an externally curved generally spherically convex part of said working portion flush with said boss when said working portion is connected to said handle portion by said formations; and a conical sleeve nut connected to said hose at said quick-release connector first portion for location of said appliance in a discharge unit or holder at said sink.

2. A hand-held appliance at a sink for washing and cleaning household dishes and the like with water, said appliance comprising:

a flexible water-supply hose connectable to a kitchen-sink fixture;

a quick-release connector first portion on an end of said flexible water-supply hose;

an attachment having at least one water-outlet orifice and comprising:

an elongated handle-portion formed with:

a generally cylindrical shank, an externally generally spherically curved convex boss at one end of said shank and merging therewith, a quick-release connector second portion adapted to mate with said quick-release connector first portion, and a coupling formation on said boss, and a working portion formed with said orifice, having a coupling formation on an externally curved generally spherically convex part of said working portion flush with said boss when said working portion is connected to said handle portion by said formations, said working portion being at least one of the following interchangeable members:

a saucepan and pot scraper, a bottle brush, a jet nozzle in line with said handle portion, and a discharge nozzle directed at 90° to said handle portion; and a conical sleeve nut connected to said hose at said quick-release connector first portion for location of said appliance in a discharge unit or holder at said sink.

3. The appliance defined in claim 2 wherein said formations are screw threads.

4. The appliance defined in claim 2 wherein said working portion is a sauce pan and pan scraper and comprises a blade extending from said convex part and means forming a plurality of said water-outlet orifices on opposite sides of said blade.

5. The appliance defined in claim 2 wherein said working portion is a bottle brush having a cylindrical projection extending from said spherically convex part, bristles positioned radially on said cylindrical projection and means forming a plurality of said water-outlet orifices arranged on a circle around said cylindrical projection for directing water into gaps between said bristles.

6. The appliance as defined in claim 2 wherein said working portion is a jet nozzle having a spigot formed on said convex part and provided with at least one nozzle orifice.

7. The appliance defined in claim 6 further comprising a cup-shaped deflector having an outlet and positioned on said spigot to intersect water from said nozzle orifice.

8. The appliance defined in claim 2 wherein said working portion is said discharge nozzle directed at 90° to said handle portion.

* * * * *